US011143472B2

(12) United States Patent
Weakley et al.

(10) Patent No.: US 11,143,472 B2
(45) Date of Patent: Oct. 12, 2021

(54) MULTI-CALIBER MAGAZINE LOADER

(71) Applicant: Tracer Tactical, LLC, Bennington, NE (US)

(72) Inventors: Derek Weakley, Bennington, NE (US); Bradley Curtis, Omaha, NE (US)

(73) Assignee: TRACER TACTICAL, LLC, Bennington, NE (US)

( * ) Notice: Subject to any disclaimer, the term of this patent is extended or adjusted under 35 U.S.C. 154(b) by 0 days.

(21) Appl. No.: 15/059,155

(22) Filed: Mar. 2, 2016

(65) Prior Publication Data

US 2021/0116196 A1 Apr. 22, 2021

Related U.S. Application Data

(60) Provisional application No. 62/126,952, filed on Mar. 2, 2015.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/84
USPC ..... 42/87, 88
See application file for complete search history.

(56) References Cited

U.S. PATENT DOCUMENTS 273,131 A * 2/1883 Nemetz ..... F41A 9/18 42/17
458,825 A * 9/1891 Daudeteau ..... F41A 9/84 42/88
482,376 A * 9/1892 Mauser ..... F41A 9/84 42/88
523,886 A * 7/1894 Durst ..... F41A 9/84 42/88
679,412 A * 7/1901 Bruce ..... F41A 9/84 42/88
768,842 A * 8/1904 Bruce ..... F41A 9/84 42/88
2,834,137 A * 5/1958 Kunz ..... F41A 9/83 42/87
2,896,353 A * 7/1959 Hunt ..... F41A 9/85 42/89
3,690,217 A * 9/1972 Brint ..... F41A 9/84 89/34
3,916,552 A * 11/1975 Pichard ..... F41A 9/84 42/87
4,005,633 A * 2/1977 Kirkpatrick ..... F41A 9/74 89/33.02
4,122,933 A * 10/1978 Starzyk ..... B65G 11/203 193/32
4,502,239 A * 3/1985 Laguna ..... F42B 39/002 42/87
4,538,371 A * 9/1985 Howard ..... F41A 9/84 42/87

(Continued)

*Primary Examiner* — Derrick R Morgan

(74) *Attorney, Agent, or Firm* — Kutak Rock LLP; Brian L. Main

(57) ABSTRACT

A device for loading a plurality of ammunition rounds or cartridges, containing a rim, groove, or flange, of non-determined size or into a firearm magazine of a non-determined capacity by means of a magazine adapter, in one or more hand strokes. The main chassis, or cartridge retainer, may be asymmetric in design allowing for ambidextrous operation and accessory expansion.

4 Claims, 6 Drawing Sheets

(56) References Cited

U.S. PATENT DOCUMENTS

| | | | | | |
|---|---|---|---|---|---|
| 4,706,402 | A * | 11/1987 | Csongor | F41A 9/84 | 42/87 |
| 4,736,667 | A * | 4/1988 | Kochevar | F41A 9/83 | 206/3 |
| 4,949,495 | A * | 8/1990 | Mari | F41A 9/83 | 42/87 |
| 5,669,171 | A * | 9/1997 | Sally | F41A 9/66 | 42/60 |
| 5,794,373 | A * | 8/1998 | Moon | F41A 15/14 | 42/25 |
| 7,497,044 | B2 * | 3/2009 | Cammenga | F41A 9/67 | 42/49.01 |
| 9,709,352 | B1 * | 7/2017 | Hess | F41A 9/84 | |
| 2003/0046854 | A1 * | 3/2003 | Urchek | F41A 9/83 | 42/87 |
| 2005/0081421 | A1 * | 4/2005 | Guy | F41A 9/83 | 42/88 |
| 2010/0313460 | A1 * | 12/2010 | Tucker | F41A 9/83 | 42/87 |
| 2012/0222343 | A1 * | 9/2012 | Kim | F41A 9/83 | 42/88 |
| 2014/0298704 | A1 * | 10/2014 | Niccum | F41A 9/83 | 42/87 |
| 2015/0377573 | A1 * | 12/2015 | Niccum | F41A 9/83 | 42/87 |
| 2020/0256631 | A1 * | 8/2020 | Plate | F41A 9/83 | |

* cited by examiner

MULTI-CALIBER MAGAZINE LOADER

The invention relates to the loading of firearm magazines, specifically the loading of multiple calibers of ammunition rounds into magazines of multiple styles and capacities. Various solutions have been offered for the rapid loading of rifle magazines. These include those disclosed in U.S. Pat. No. 7,059,077 to Tal et al., which utilizes a pusher device and a channel to direct loose cartridges into a magazine. However, such loaders are configured in such a way as to only work with cartridges having case heads of a single diameter.

BACKGROUND

Many cartridge calibers may share a common case head diameter. The case head being the portion of the cartridge case distal from the mouth and bullet and including the rim or extraction groove (in the case of a rimless cartridge). For example, 0.223 REM, 5.56×45 mm, 0.300 BLK, and a number of other rounds share the same case head diameter. However, many armories, police departments, and recreational shooters own rifles that utilize different case head diameters. For example, the owner of three common rifles, an AR-15 in 5.56×45 mm, an M14 pattern rifle in 7.62×51 mm, and an AK47 pattern rifle in 7.62×39 mm would need to load magazines for cartridges having three different case head diameters. Accordingly, such a user would need three of the devices described in the '077 patent, one for each distinct case head diameter.

Accordingly, there is a need for a magazine loader capable of enabling the rapid loading of magazines for multiple calibers of cartridges having different case head diameters.

SUMMARY

A movable elongated mechanism to hold the rim or flange of the cartridges, allows for a one-way insertion of cartridges into a magazine loader. The device may contain a plurality of such rimlock components or retainers to prevent any round smaller than the largest acceptable round from easily dislodging from a slide way. The movable rimlock may be part of an assembly consisting of a receiving channel and one or more springs in the form of a curved and pressed metal strip to provide elasticity and resistance to the rimlock operation. In such embodiments, the rimlock component is primarily triangular and allows for smooth insertion of ammunition. The rimlock ramp component contains one or more flanges which extend the length of the ramp in order to be received by the channel which also contains the spring, allowing for the ramp to move upward and downward during the round insertion process as well as the final resting round height while in the slideway.

In other embodiments, the rimlock may comprise a plurality of segmented rimlock pieces configured to accommodate tapered cartridges along an arcuate slideway. Such pieces may be independently coupled to the slideway allowing for individual replacement and modularity. The use of separate pieces can simplify manufacture by allowing several, identical, straight lock portions to be positioned into an arcuate arrangement to facilitate use of tapered cartridges. A mechanism embodied in the rim-end channel that allows for one-way insertion of said ammunition wherein:

An attachable device that will allow for a plurality of magazine types and calibers. The adapter on one side has a picatinny rail, or similar to that of a dovetail allowing for easy and quick toothless removal and operation of the adapter. The adapter also allows for one-handed ambidextrous operation due to the magazine being locked in place with a spring-action lever situated on the top-side of the adapter. In other embodiments, this lever may be located to the front or rear and utilizes the native locking mechanism for said magazine, also used by the receiver on the weapon. The magazine adapter also contains a spring mechanism that allows for quick easy removal of a loaded or unloaded magazine. In some embodiments, multiple magazine adapters may be provided whereby magazines of different specifications may be used with the magazine loader.

A pusher device with convex ends to couple or better control the ammunition in the slideway, with a handle more ergonomic by allowing the ammunition to be pushed with the major arm muscles (biceps and triceps) rather than a pulling motion using the many minor arm muscles of the forearm and wrist is also provided.

Several exemplary objects and advantages of the invention are to provide a device to quickly load magazines:

- Without the need to exchange slideways (e.g., tray, bed, etc.).
- loading of multiple calibers of ammunition rounds into magazines
- ability to load multiple styles and capacities of magazines
- expandable slideway extensions and accessories
- multiple receiver adapters for many magazine types, styles, and capacities
- one-handed ambidextrous operation
- ergonomic interchangeable pushing handle
- design utilizes the primary muscles of the arm versus the minor muscles of the forearm
- magazine(s) lock into place utilizing magazine's locking feature
- spring-action magazine release allows for fast removable of magazines
- non-slip device operation for multiple operating surfaces
- rimlock prevents rounds from being lifted during the loading process
- strap clips carrying device

DETAILED DESCRIPTION OF THE DRAWINGS

Figure 1:
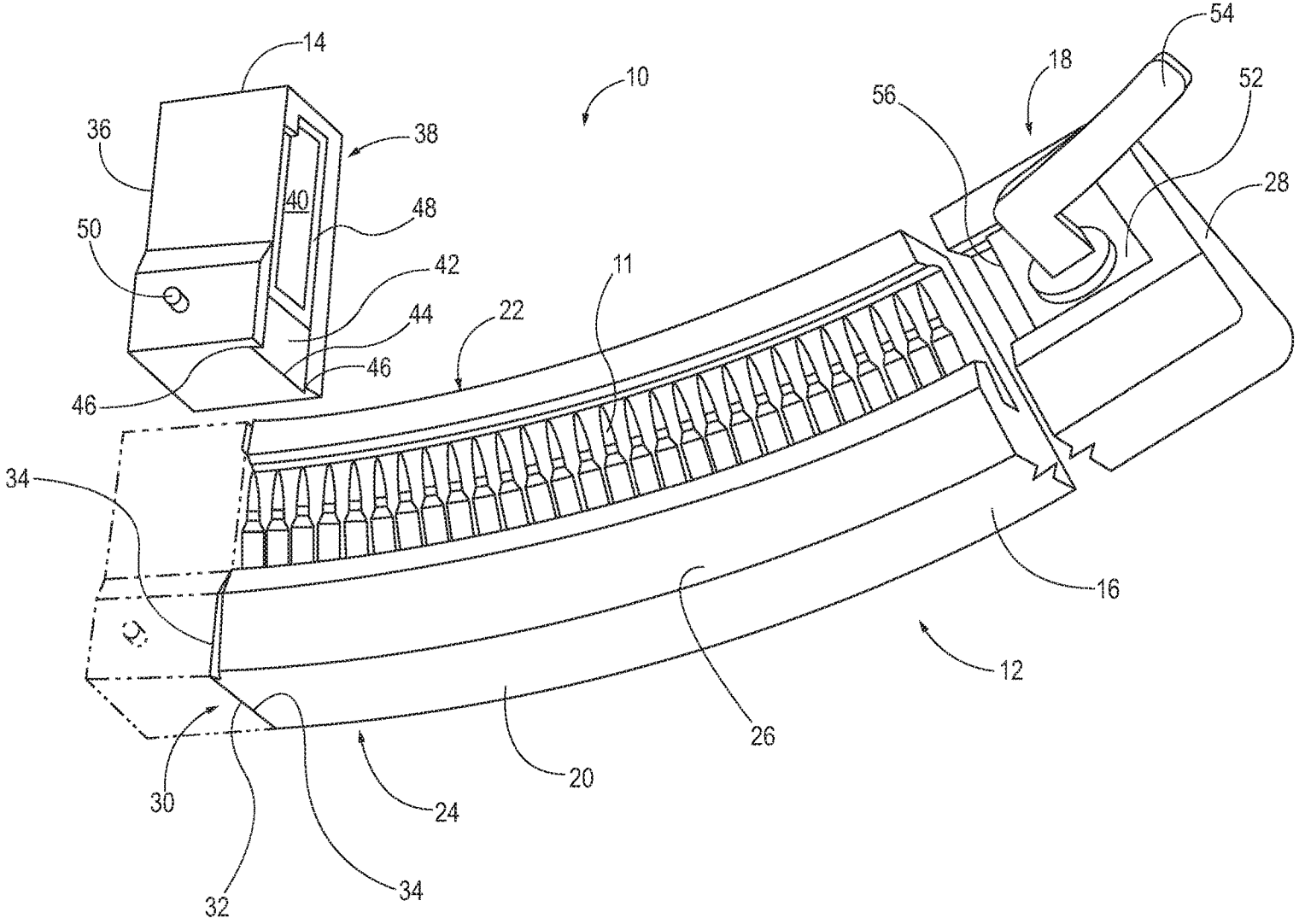
FIG. 1 is a top-front elevation view of a magazine loading device.

Referring in general to FIGS. 1-4 and in particular FIG. 1, a magazine loading device 10 for loading cartridges 11 into a firearm magazine is shown. Device 10 includes cartridge retainer 12, magazine adapter 14, and a cartridge pusher 18. Cartridge retainer 12 is generally shown as having a slightly arcuate shape to accommodate tapered cartridges, however cartridge retainer 12 may alternatively be straight or of other suitable geometry. Cartridge retainer 12 includes exterior surfaces, such as first side 20, second side 22, bottom 24 and top side 26. Cartridge retainer 12 is bound at a first end 28 and open at a second end 30. At second end 30, a dove tail interface 32 is provided with projections 34 extending from first side 20 towards second side 22.

Magazine adapter 14 includes a magazine receiving end 36 and an interfacing end 38 for coupling to cartridge retainer 12. Channel 40 passes between magazine end 36 and interfacing end 38 and is bound on 4 sides but is open to allow a reception of the magazine at end 36 and reception of cartridges from cartridge retainer 12. A transverse channel 42 is generally a female dove tail channel having a surface 44 and subchannels 46 configured to mate to extensions 34 on magazine retainer 12. This configuration allows magazine adapter 14 to be slidably coupled to cartridge retainer 12 and selectively removed. This allows for a plurality of magazine adapters to be used depending upon the type of magazine to be loaded.

As shown in the figures attached hereto, a magazine adapter for STANAG magazine, such as those used by the AR15 are contemplated. In addition, a variety of other magazines and magazine adapters may be used in conjunction with magazine retainer 12 and pusher 18 to allow device 10 to be used with any of a plurality of magazine designs. In use, a user may fill magazine retainer 12 with cartridges 11 as shown having pusher 18 positioned proximate to end 28. A magazine may be received by magazine adapter 14 at magazine end 36 and cartridges 11 pushed through channel 40 by applying force with pusher 18 until all cartridges are loaded.

Figure 2A:
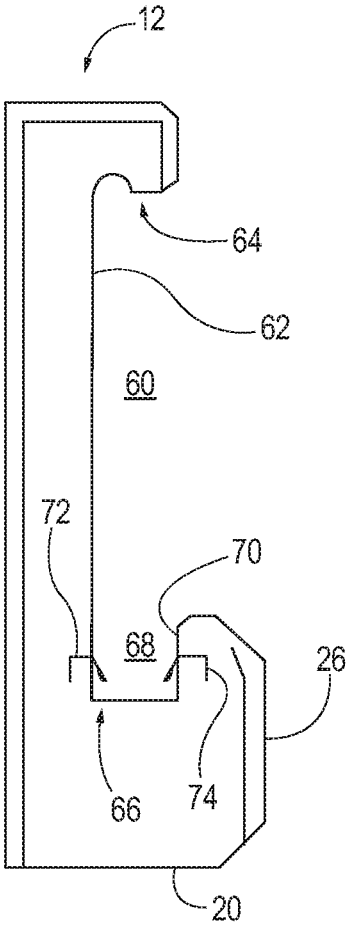
FIG. 2A is a plan, cross-sectional view of the magazine loading device of FIG. 1.
Figure 2B:
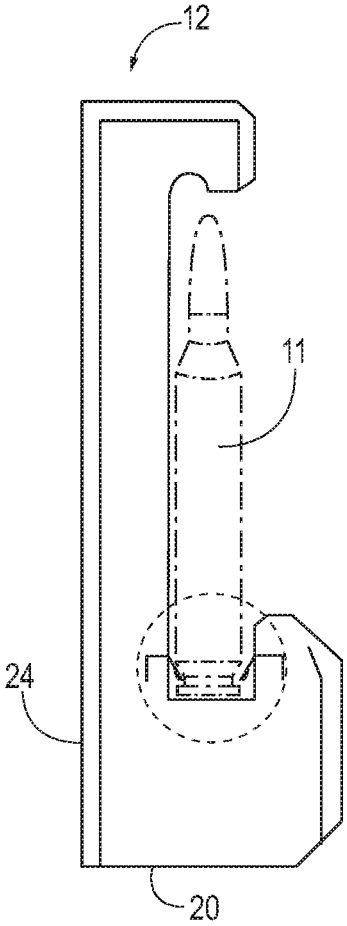
FIG. 2B is a plan, cross-sectional view of the magazine loading device of FIG. 1.
Figure 3:
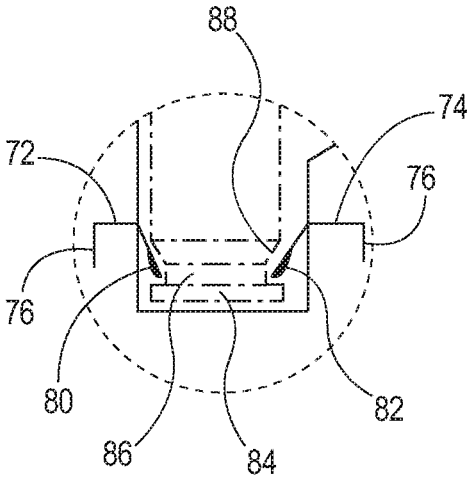
FIG. 3 is a plan, cross-sectional view of the magazine loading device of FIG. 1.

Referring to FIGS. 2A, 2B, and 3, FIG. 2A shows a cross-sectional view of cartridge retainer 12 while FIG. 2B shows the same view with cartridge 11 positioned therein in relief. FIG. 3 shows, in greater detail, a subportion of FIG. 2B. In general, cartridge retainer 12 defines a channel 60 for receiving and retaining cartridges to be loaded into a magazine. Channel 60 is bound by lower surface 62, a bullet end 64, and a case head end 66. A subpart of channel 60 is case head channel 68 bound at one end by case head end 66, lower wall 62, and upper wall 70. Within case head channel 68 are positioned resilient members 72 and 74.

Referring to FIG. 3, resilient members 72 and 74 each comprise a first end 76 and 78 disposed within the structure of cartridge retainer 12. Each of resilient members 72 and 74 extend into case head channel 68 from lower wall 60 and upper wall 70, respectively. Each of resilient members 72 and 74 are angled toward case head end 66 with ends 80 and 82.

In use, a cartridge 11 is positioned within case retainer 12 with the case head positioned on a side of resilient members 72 and 74 distal to case head end 66. Cartridge 11 then may be pushed towards case head end 66 whereby cartridge rim 84 displaces ends 80 and/or 82 of resilient members 72 and 84 away from each other to accommodate the diameter of cartridge rim 84 as cartridge rim 84 is displaced towards case head end 66. Once cartridge rim 84 is sufficiently close to case head end 66, resilient members 72 and 74 will displace themselves into a locking configuration as shown in FIG. 3. In the locking configuration, ends 80 and 82 occupy a position within an extractor groove 86 of cartridge 11. In some embodiments, resilient members 72 and 74 may be constructed of spring steel, an elastomer material, or other sufficiently resilient material. While shown as a "rimless" cartridge, cartridge 11 may be a rimmed cartridge without an extractor groove 86, such as a rimfire cartridge, or cartridges similar in design to a 7.62×54r cartridge. In practice, the geometry of case head channel 68 may be configured such that a spacing between ends 80 and 82 and a diameter set by ends 80 and 82 are configured to accommodate a wide range of cartridges.

Figure 4:
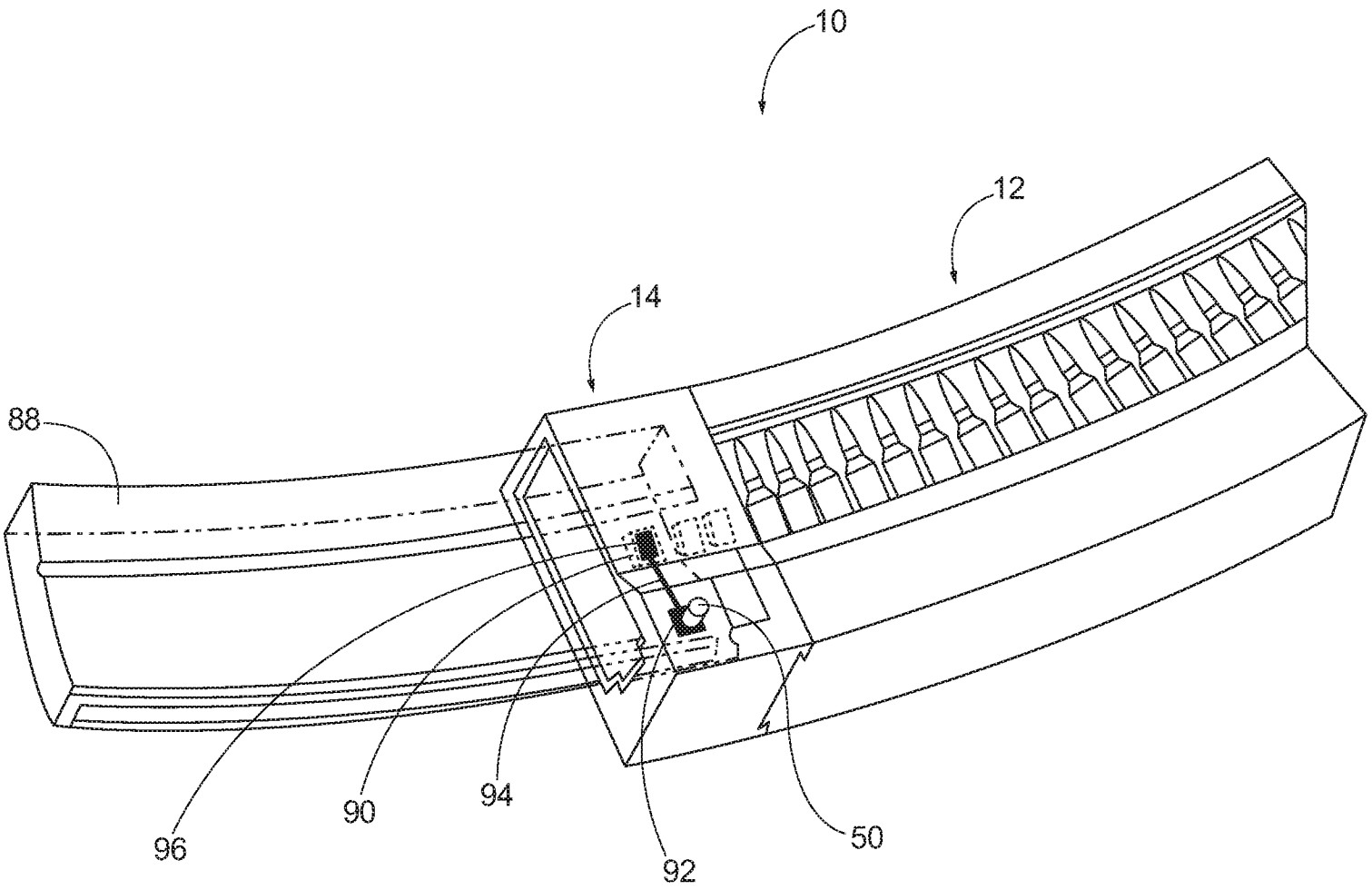
FIG. 4 is a top-front elevation view of the magazine loading device of FIG. 1.

Referring to FIG. 4, device 10 including cartridge retainer 12 and magazine adapter 14 is shown. Magazine 88 is shown in position to receive cartridges 11. Magazine 88 is shown as a STANAG magazine, with a magazine catch 90 positioned in a side wall of magazine 88. Magazine release 50 is positioned on magazine adapter 14 and is shown as a button. Below magazine release 50 may be a spring, such as a coil spring 92, configured to bias magazine release 50 into a position extending outward from an outer surface of magazine adapter 14. Configured at roughly a 90° angle to magazine release 50, is a lever arm 94. Lever arm 94 may be positioned over a lever point positioned between magazine interface 96 and magazine release 50. In use, a user may position magazine 88 such that it is fully seated within magazine adapter 14. When fully seated, magazine interface 96 will mate with magazine catch 90 in magazine 88 locking magazine 88 in a position relative to magazine adapter 14. With cartridges in magazine retainer 12, the user may then use pusher 18 to apply a force sufficient to drive cartridges 11 into magazine 88. After loading magazine 88 with cartridges 11, the user may depress magazine release 50 compressing spring 92 and lifting magazine interface 96 out of magazine catch 90 such that magazine 88 is thereby unlocked from its position relative to magazine adapter 14 and may be removed by the user.

Figure 5:
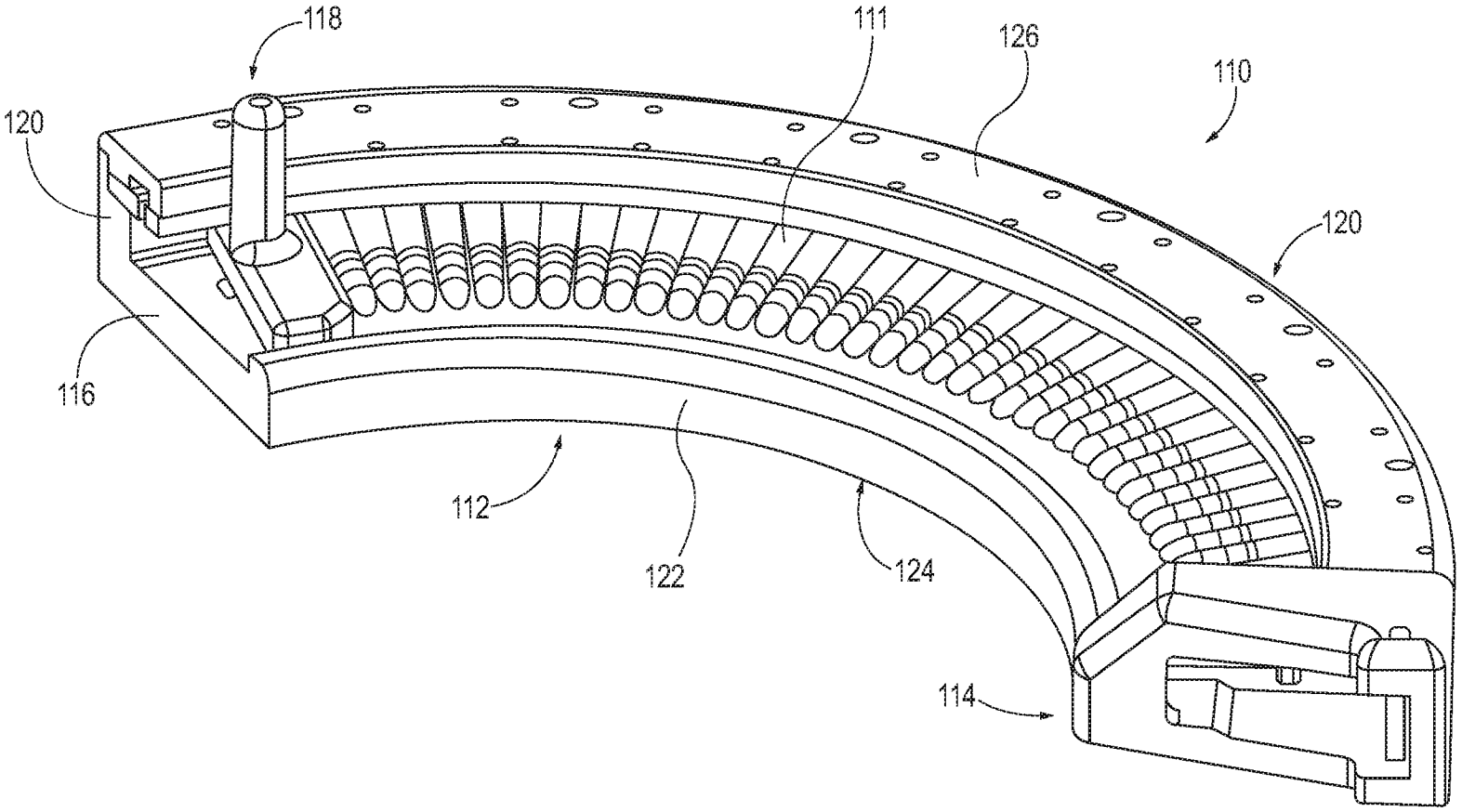
FIG. 5 is a top-back elevation view of a magazine loading device.
Figure 6:
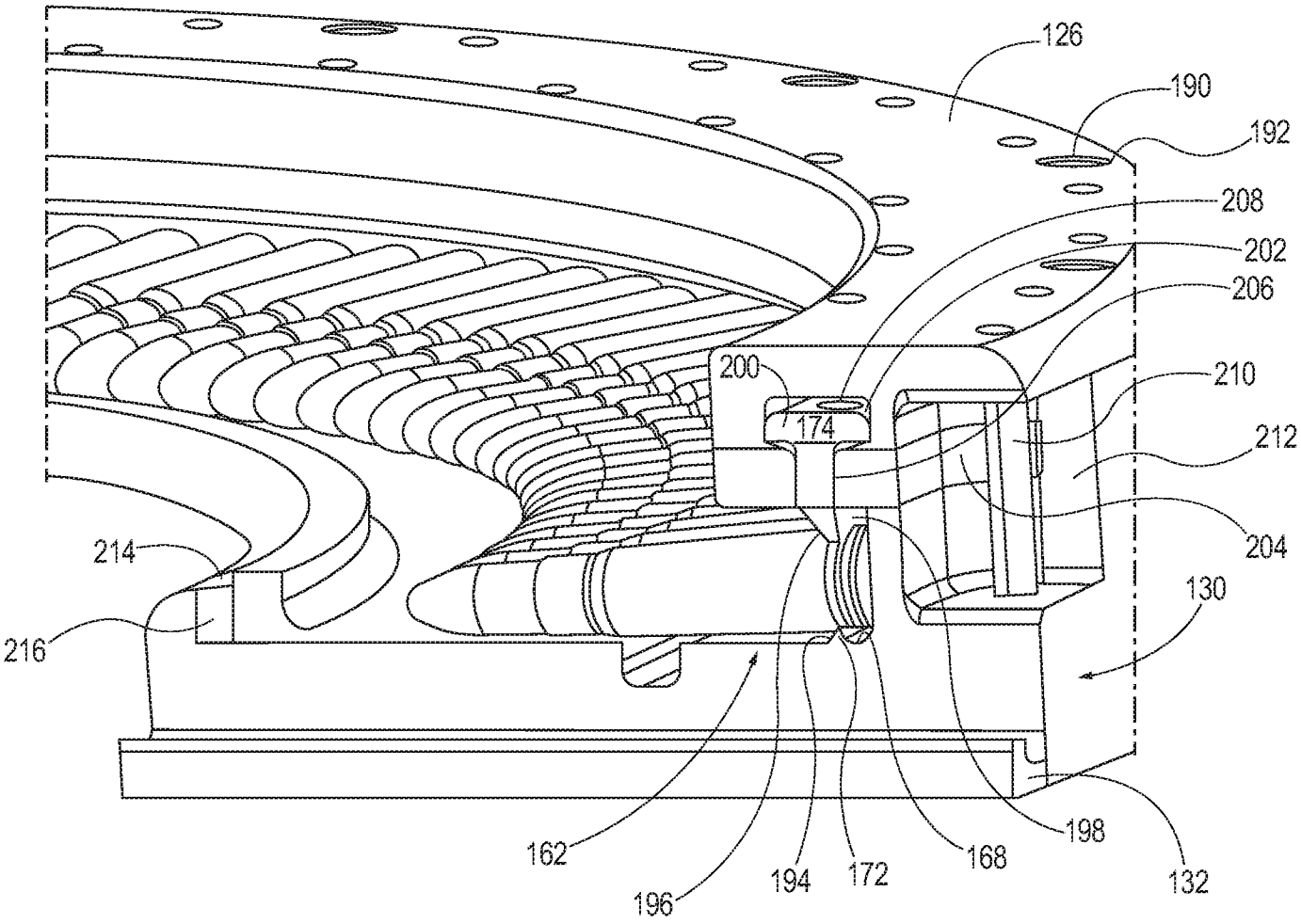
FIG. 6 is an end elevation view of the magazine loader of FIG. 5.
Figure 7:
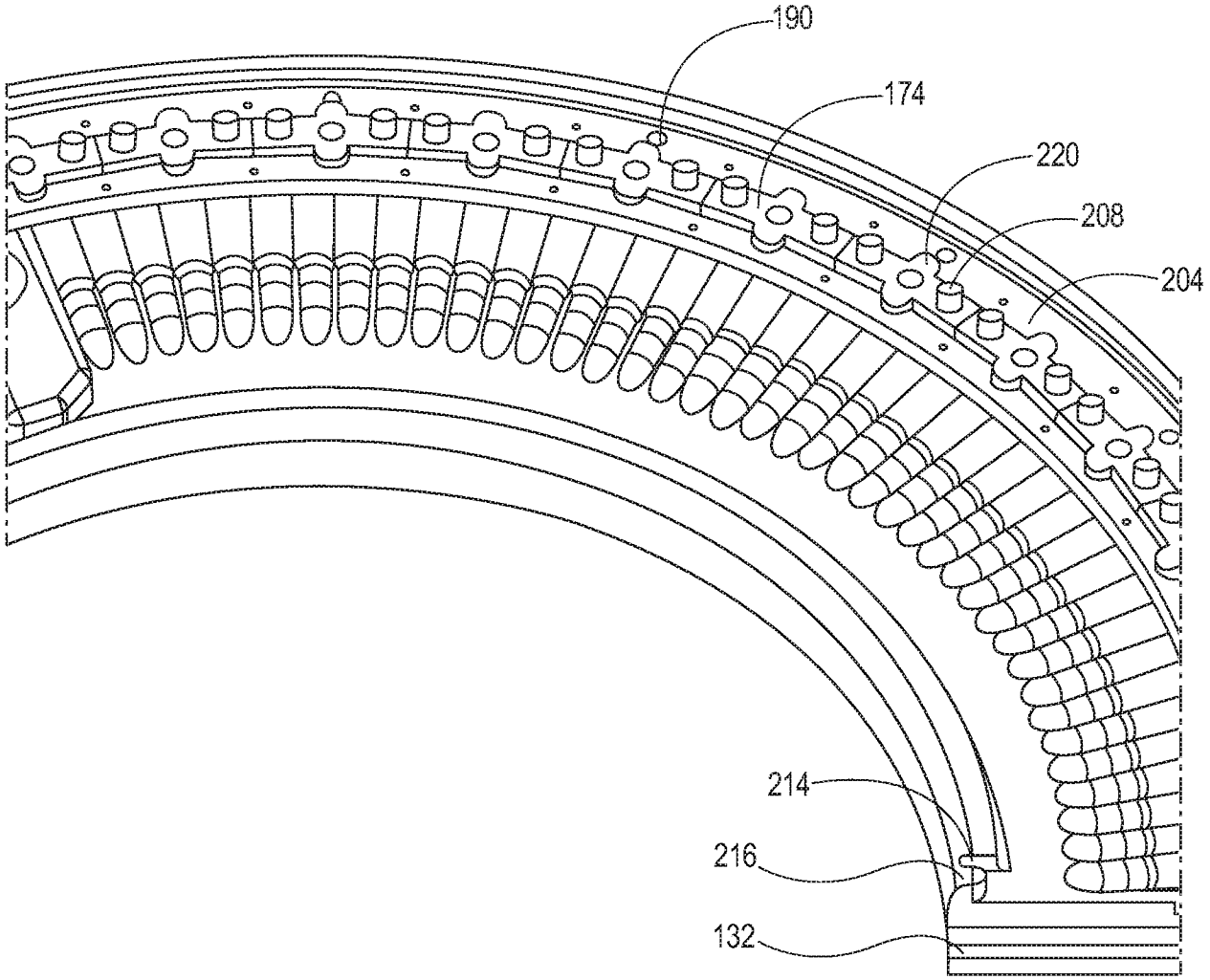
FIG. 7 is another top-back elevation view of the magazine loading device of FIG. 5.

Referring in general to FIGS. 5-7 and in particular FIG. 5, a magazine loading device 110 for loading cartridges 111 into a firearm magazine is shown according to an alternative embodiment. Device 110 includes cartridge retainer 112, magazine adapter 114, and a cartridge pusher 118. Cartridge retainer 112 is generally shown as having a slightly arcuate shape to accommodate tapered cartridges, however cartridge retainer 112 may alternatively be straight or of other suitable geometry. Cartridge retainer 112 includes exterior surfaces, such as first side 120, second side 122, and bottom 124. A top panel 126 may be removably coupled top cartridge retainer 112.

FIG. 6 shows cartridge retainer 112 with magazine adapter 114 removed. While similar in function to the device of FIGS. 1-4, a removable top panel 126 may be coupled by a plurality of fasteners 190 passing through openings 192 and interfacing with cartridge retainer 112 proximate to first side 122. A fixed projection 172 in conjunction with a moveable retainer 174 may be used in place of the springs 72 and 74 shown in FIG. 2A. Fixed projection 172 extends upwardly from surface 162 and includes an angled face 194 configured to allow a cartridge case head to be directed up and over projection 172 such that the cartridge may rest with projection 172 either within an extraction groove (in the case of a rimless cartridge) or along a cartridge rim on a side proximate to the case mouth. Similarly, when a cartridge case head is pushed into channel 168, the force of the case head bearing against an angled surface 196 of moveable retainer 174, may displace moveable retainer 174 upwardly. When the cartridge rim passes (or the extraction groove of the cartridge aligns with) a lower portion 198 of moveable retainer 174, removable retainer 174 moves downwardly to block removal of the cartridge from case head channel 168.

Removable retainer 174 is shown as having a general 'T' shaped crossection with a wide transverse section 200 disposed within a channel 202 formed in the underside of top panel 126 and shown as a 'U' shaped channel. Intermediate portion 204 is disposed below top panel 126 and may be formed as a single unitary body with retainer 112. Intermediate portion 206 includes a plurality of openings 206 having a width smaller than the width of channel 202 such that moveable retainer 174 may be retained as shown. When a cartridge case is moved into channel 168, moveable retainer 174 moves upward and compresses spring 208 which, in turn, biases moveable retainer 174 downward when the case is in position.

Pin 210 is shown disposed within recess 212 and may be used to retain magazine adapter 114. Additionally, member 132 may be provided proximate to second end 130. Member 132 may have a longitudinal groove, as shown, or other features to facilitate locating and locking magazine adapter 114 in place when in use. Additionally, a recess 214 and projection 216 may be provided to further restrict the free motion of magazine adapter 114 when in use.

Referring to FIG. 7, the magazine loading device 110 of FIG. 6 is shown with top panel 126 removed. As shown, a plurality of moveable retainers 174 are provide. Each of the moveable retainers 174 is biased downwardly by a pair of springs 208 and each moveable retainer is a generally straight segment. The arrangement of the plurality of moveable retainers allows for the forming of an arc that can accommodate tapered cartridges. As shown, in some embodiments, moveable retainers may include extensions 220 that inhibit rocking of the moveable retainer about a longitudinal axis of its transvers portion 200.

Referring to FIG. 8, magazine adapter 114 includes a magazine receiving end 36 and an interfacing end 138 for coupling to cartridge retainer 112. Channel 140 passes between magazine end 136 and interfacing end 138 and is bound on 4 sides but is open to allow a reception of the magazine at end 136 and reception of cartridges from cartridge retainer 112. This configuration allows magazine adapter 114 to be removably coupled to cartridge retainer 112 and selectively removed. This allows for a plurality of magazine adapters to be used depending upon the type of magazine to be loaded.

As shown in the figures attached hereto, a magazine adapter for STANAG magazine, such as those used by the AR15 are contemplated. In addition, a variety of other magazines and magazine adapters may be used in conjunction with magazine retainer 112 and pusher 118 to allow device 110 to be used with any of a plurality of magazine designs. In use, a user may fill magazine retainer 112 with cartridges 111 as shown having pusher 118 positioned proximate to end 128. A magazine may be received by magazine adapter 114 at magazine end 36 and cartridges 111 pushed through channel 140 by applying force with pusher 118 until all cartridges are loaded.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The terminology used in the description herein is for the purpose of describing particular embodiments only and is not intended to be limiting of the invention. As used in the description of the embodiments and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, and similarly, a second without departing from the teachings of the present invention.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims.

What is claimed is:

1. A magazine loading device comprising:

a cartridge retainer having a first end, a second end, a first side, and a second side, the cartridge retainer configured to retain cartridges in a generally horizontal orientation;

a case head channel disposed along the interior surface of the second side of the cartridge retainer, the case head channel defined in part by a lower wall extending horizontally;

a case head end running vertically from the lower wall, and an upper wall extending horizontally from a top of the case head end and over the lower wall to provide a three-sided channel that is open towards the first end of the cartridge retainer;

at least one retention member extending into the case head channel from one of the upper wall or lower wall;

at least one fixed projection extending from the other of the upper wall or lower wall;

wherein the at least one retention member is configured to translate relative to the at least one fixed projection by a cartridge case head being displaced towards the case head end, and engage with the rim or extractor groove of a cartridge case; and wherein the relative movement of the at least one retention member is configured to allow for cartridge cases of various calibers.

2. The magazine loading device of claim 1 further comprising a magazine adapter having a first end, a second end, and a channel passing between the first end and second end such that a magazine may be positioned therein and receive cartridges from the cartridge retainer.

3. The magazine loading device of claim 1 further comprising a pusher for driving cartridges in the cartridge retainer through the magazine adapter and into a magazine.

4. A magazine loading device comprising:

a cartridge retainer having a first end, a second end, a first side, and a second side, the cartridge retainer configured to retain cartridges in a generally horizontal orientation;

a case head channel disposed along the interior surface of the second side of the cartridge retainer, the case head channel defined in part by a lower wall extending horizontally;

a case head end running vertically from the lower wall, and an upper wall extending horizontally from a top of the case head end and over the lower wall to provide a three-sided channel that is open towards the first end of the cartridge retainer;

a plurality of moveable retention members extending into the case head channel from one of the upper wall or lower wall;

at least one fixed projection extending from the other of the upper wall or lower wall;

a magazine adapter having a first end, a second end, and a channel passing between the first end and second end such that a magazine may be positioned therein and receive cartridges from the cartridge retainer; and a pusher for driving cartridges in the cartridge retainer through the magazine adapter and into a magazine; and wherein each of the plurality of retention members is configured to be displaced upwardly by a cartridge case head being displaced towards the case head end, and engage with the rim or extractor groove of a cartridge case and the fixed projection is configured to engage the rim or extractor groove of a cartridge simultaneously with the plurality of moveable retention members.

* * * * *